US007628221B2

(12) United States Patent
Hartmann et al.

(10) Patent No.: US 7,628,221 B2
(45) Date of Patent: Dec. 8, 2009

(54) HAND-HELD POWER TOOL WITH A PNEUMATIC PERCUSSION MECHANISM

(75) Inventors: Markus Hartmann, Mauerstetten (DE); Stefan Dorner, Kaufbeuren (DE); Peter Sternberger, Reiengen (DE)

(73) Assignee: Hilti Aktiengesellscahft, Schaan (LI)

( * ) Notice: Subject to any disclaimer, the term of this patent is extended or adjusted under 35 U.S.C. 154(b) by 142 days.

(21) Appl. No.: 12/069,108

(22) Filed: Feb. 6, 2008

(65) Prior Publication Data

US 2008/0202782 A1 Aug. 28, 2008

(30) Foreign Application Priority Data

Feb. 8, 2007 (DE) ..... 10 2007 000 081

(51) Int. Cl.
*B25D 11/06* (2006.01)

(52) U.S. Cl. ..... 173/104; 173/108; 173/128; 173/200; 173/204

(58) Field of Classification Search ..... 173/104, 173/108, 128, 200, 201, 204
See application file for complete search history.

(56) References Cited

U.S. PATENT DOCUMENTS

| | | | | |
|---|---|---|---|---|
| 3,866,690 | A * | 2/1975 | Lance et al. | 173/15 |
| 4,102,410 | A * | 7/1978 | Ross | 173/133 |
| 4,336,848 | A * | 6/1982 | Wanner | 173/210 |
| 4,567,951 | A * | 2/1986 | Fehrle et al. | 173/201 |
| 4,712,625 | A * | 12/1987 | Kress | 173/104 |
| 4,732,217 | A * | 3/1988 | Bleicher et al. | 173/104 |
| 4,798,249 | A * | 1/1989 | Hoereth et al. | 173/14 |
| 5,052,498 | A | 10/1991 | Gustafson et al. | |
| 5,203,417 | A * | 4/1993 | Glaser | 173/200 |
| 5,727,639 | A * | 3/1998 | Jeter | 173/132 |
| 5,975,217 | A * | 11/1999 | Frenzel et al. | 173/201 |
| 5,992,541 | A * | 11/1999 | Frenzel et al. | 173/201 |
| 6,155,472 | A * | 12/2000 | Deziel | 227/8 |
| 6,467,555 | B2 * | 10/2002 | Plank et al. | 173/201 |
| 6,484,814 | B2 * | 11/2002 | Bongers-Ambrosius | 173/2 |
| 6,568,484 | B1 * | 5/2003 | Schmid et al. | 173/201 |
| 6,666,284 | B2 * | 12/2003 | Stirm | 173/97 |
| 6,863,134 | B2 * | 3/2005 | Seith et al. | 173/1 |
| 7,404,451 | B2 * | 7/2008 | Neumann | 173/109 |
| 2002/0134563 | A1 * | 9/2002 | Stirm | 173/201 |
| 2006/0243468 | A1 | 11/2006 | Meixner et al. | |

FOREIGN PATENT DOCUMENTS

DE 2641070 3/1978

OTHER PUBLICATIONS

European Search Report.

* cited by examiner

*Primary Examiner*—Brian D Nash
(74) *Attorney, Agent, or Firm*—Abelman, Frayne & Schwab

(57) ABSTRACT

A pneumatic percussion mechanism for a hand-held power tool includes a percussion piston (23) displaceable in a guide tube (21) for applying impacts to an anvil (24), a driving member (22) reciprocating in the guide tube (21) for driving the percussion piston, and an air spring (25) for transmitting a driving torque from the driving member (22) to the percussion piston (23) and directly switchable on and off by the anvil (24).

11 Claims, 4 Drawing Sheets

HAND-HELD POWER TOOL WITH A PNEUMATIC PERCUSSION MECHANISM

BACKGROUND OF THE INVENTION

1. Field of the Invention

The present invention relates to a pneumatic percussion mechanism for a hand-held power tool such as, e.g., a chisel or combination hammer and including a guide tube, an anvil, a percussion piston displaceable in the guide tube for applying impacts to the anvil, a driving member reciprocating in the guide tube for driving the percussion piston and an air spring for transmitting a driving torque from the driving member to the percussion piston and switchable between active and passive conditions.

2. Description of the Prior Art

German Publication DE 43 10 835 A1 discloses a hand-held, electrically driven rotary-percussion or percussion hammer having a motor-driven percussion mechanism arranged in the tool housing. The percussion mechanism includes a driving member, such as a driving piston displaceable in a guide tube and reciprocated with a rod actuatable by the motor. The driving member drives, via an air cushion or an air spring a percussion piston likewise displaceable in the guide tube and applying, through an anvil, blows or impacts to a working tool received in the power tool chuck. The anvil is formed, at its end remote from the working tool, with a pot-shaped section, in the pot space of which the percussion piston is partially received. A seal, which is provided between the pot-shaped anvil and the guide tube seals the percussion mechanism against release of the lubricant outwardly. The air spring is controlled by a sleeve displaceable over the guide tube and which opens or closes aeration bores in the guide tube. The sleeve is controlled indirectly by the anvil. The drawback of the above-described percussion mechanism consists in that several components are needed for controlling the air spring. Therefore, the costs associated with manufacturing and assembly of the percussion mechanism are elevated.

Accordingly, an object of the present invention is to provide a percussion mechanism in which the foregoing drawback of the known mechanism is eliminated, and in which the air spring can be controlled in a simple way.

Another object of the present invention is a hand-held power tool with a percussion mechanism having a simply controlled air spring.

SUMMARY OF THE INVENTION

These and other objects of the present invention, which will become apparent hereinafter, are achieved by controlling the air spring directly with the anvil.

The use of the anvil for switching the air spring on or off significantly simplifies the control of the air spring and reduces the constructional space occupied by the percussion mechanism. The weight of the power tool and the manufacturing costs are likewise reduced due to the reduction in the number of parts necessary for affecting the air spring control.

Advantageously, the anvil forms a closing body of an air spring controlling valve, which represents a constructively simple solution of the direct control of the air spring with the anvil.

It is advantageous, when the anvil is formed as a pot-shaped member having a pot section provided with a valve section that forms the closing body. This measure permits to reduce the length of the anvil despite its large mass, and permits to realize the air spring control, using the pot section of the anvil.

It is further advantageous when there is provided a first seal located between the guide tube and the valve section. The first seal forms, together with the valve section, the air-spring controlling valve. For switching the air spring on, the seal seals the space, which is located between the driving member, e.g., driving piston, and the percussion piston, against one or a plurality of aeration openings which, e.g., are formed in the guide tube.

Advantageously, the guide tube has a drive section having a first inner diameter in which the driving member is displaceable, and an anvil section adjoining the drive section in which the pot section of the anvil is received and which has a second inner diameter. This provides for displacement of the percussion piston in the pot section of the anvil and in the drive section of the guide tube.

It is further advantageous when the first seal is arranged on an inner surface of the anvil section of the guide tube adjacent to a transition area between the anvil section and the drive section. Thereby, switching of the air spring on is only achieved at almost complete displacement of the anvil up to the stop or up to the transition area between the anvil and the drive section and, thus, when the working tool is completely pressed against a workpiece. At the same time, at a weak pressure of the working tool against the workpiece, a reduced impact force is provided because the anvil, which acts as a closing body of the air spring controlling valve, opens it only for a short time or only partially.

It is also advantageous when the pot section has an interior pot space in which the percussion piston can completely be received, or its axial length is at least as large as the axial length of the percussion piston. Therefore, at an open valve or the switched-off air spring, the percussion piston cannot be drawn in the direction of the driving piston, and the percussion mechanism is reliably disabled in absence of a press-on force.

Advantageously, the pot space has a diameter that corresponds to the first inner diameter of the drive section of the guide tube. Thereby, the percussion piston can reciprocate between the pot space and the drive section of the guide tube during operation of the percussion mechanism when the air spring is switched on.

According to a further advantageous embodiment of the invention, the anvil has an axially extending, elongate extension over which the annular percussion piston is axially displaceable, and which has, at its end adjacent to the driving member, a valve section that forms the closing body that cooperates with an annular portion of the driving member which encloses an aeration opening. This also permits to reduce the length of the anvil despite its large mass, providing simultaneously for control of the air spring with the elongate bar-shaped extension of the anvil.

Advantageously, in the embodiment described immediately above, the first seal of the valve is located between the valve section of the anvil and the annular portion of the driving member. The first seal seals the space between the driving member and percussion piston relative to the aeration opening of the valve, which is provided in the annular portion of the driving member, for switching the air spring on.

In a constructively advantageous embodiment, the first seal is provided on the annular portion of the drive member radially inwardly of the annular portion.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
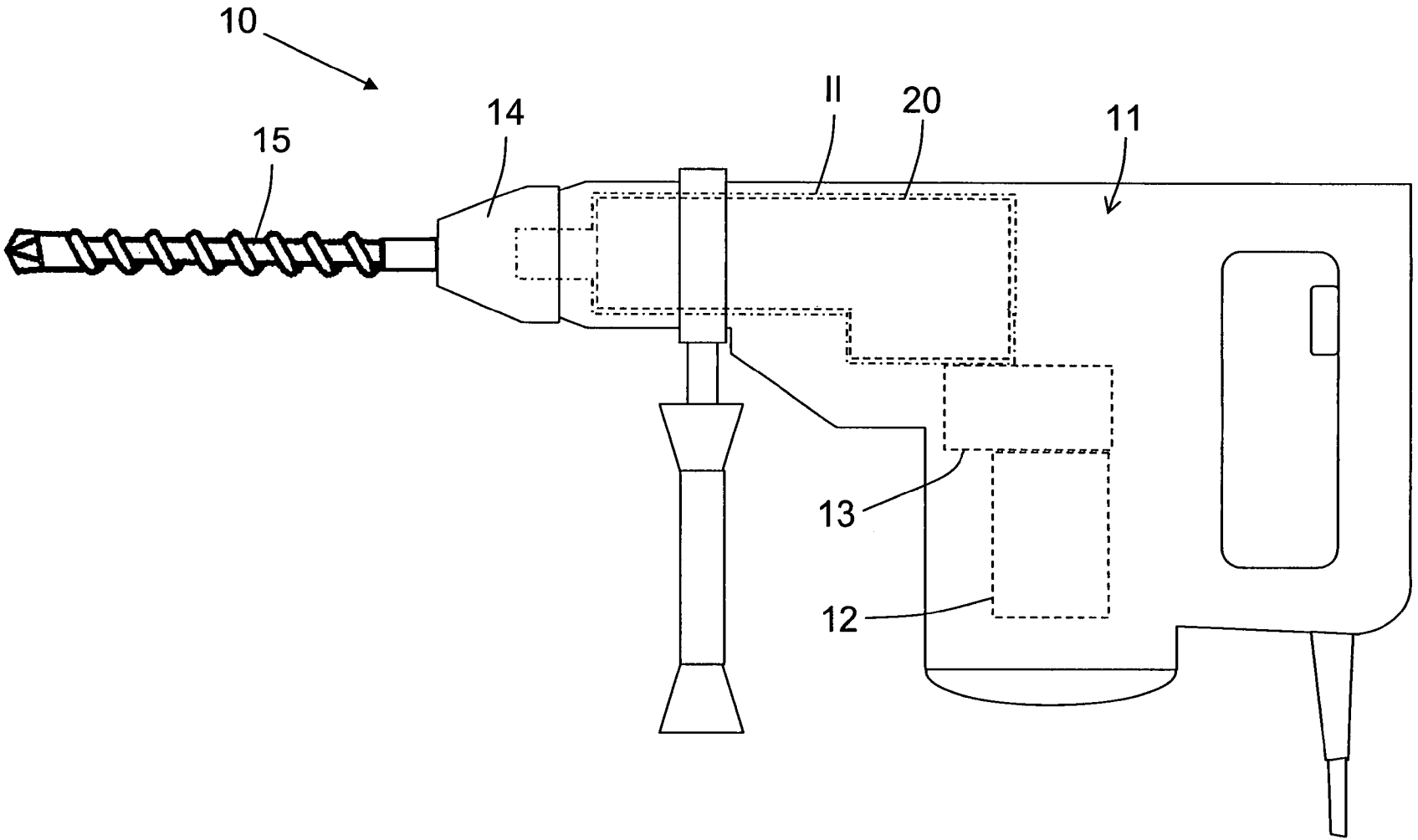
FIG. 1 a side view of a hand-held power tool with a pneumatic percussion mechanism.

A hand-held power tool 10 according to the present invention, which is formed as a rotary-percussion combination hammer shown in FIG. 1, includes a housing 11 and located in the housing 11, a percussion mechanism 20 acting on a working tool 15 received in a chuck 14, a drive gear 13 and a motor 12. A driven shaft 16 connects the percussion mechanism 20 with the drive gear 13 that transmits a rotational movement of the motor 12 to the percussion mechanism 20.

Figure 2:
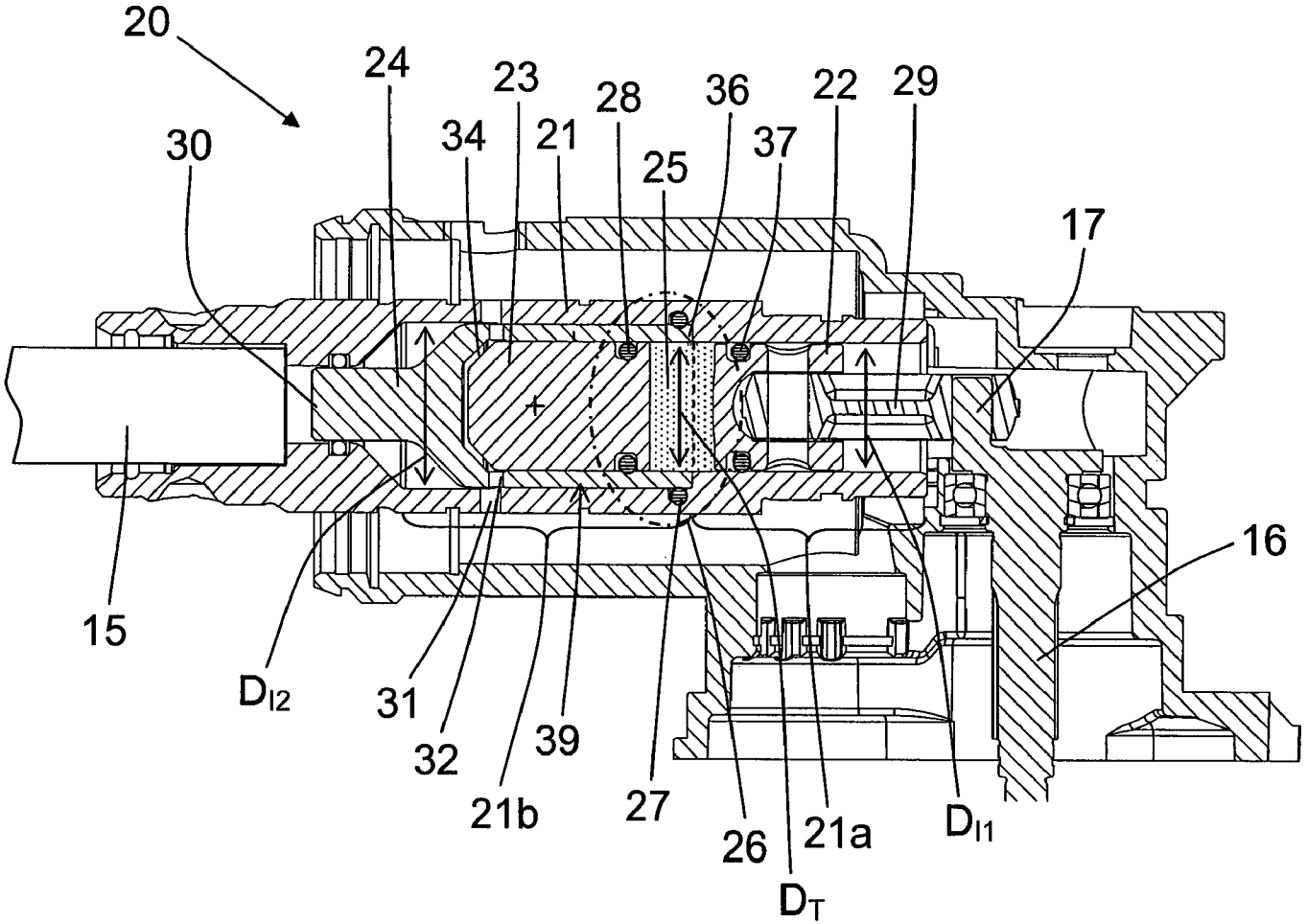
FIG. 2 a cross-sectional view of a section of the hand-held power tool according to mark II in FIG. 1 at an increased in comparison with FIG. 1, scale and in a condition of the power tool in which the power tool is pressed against a workpiece.
Figure 3:
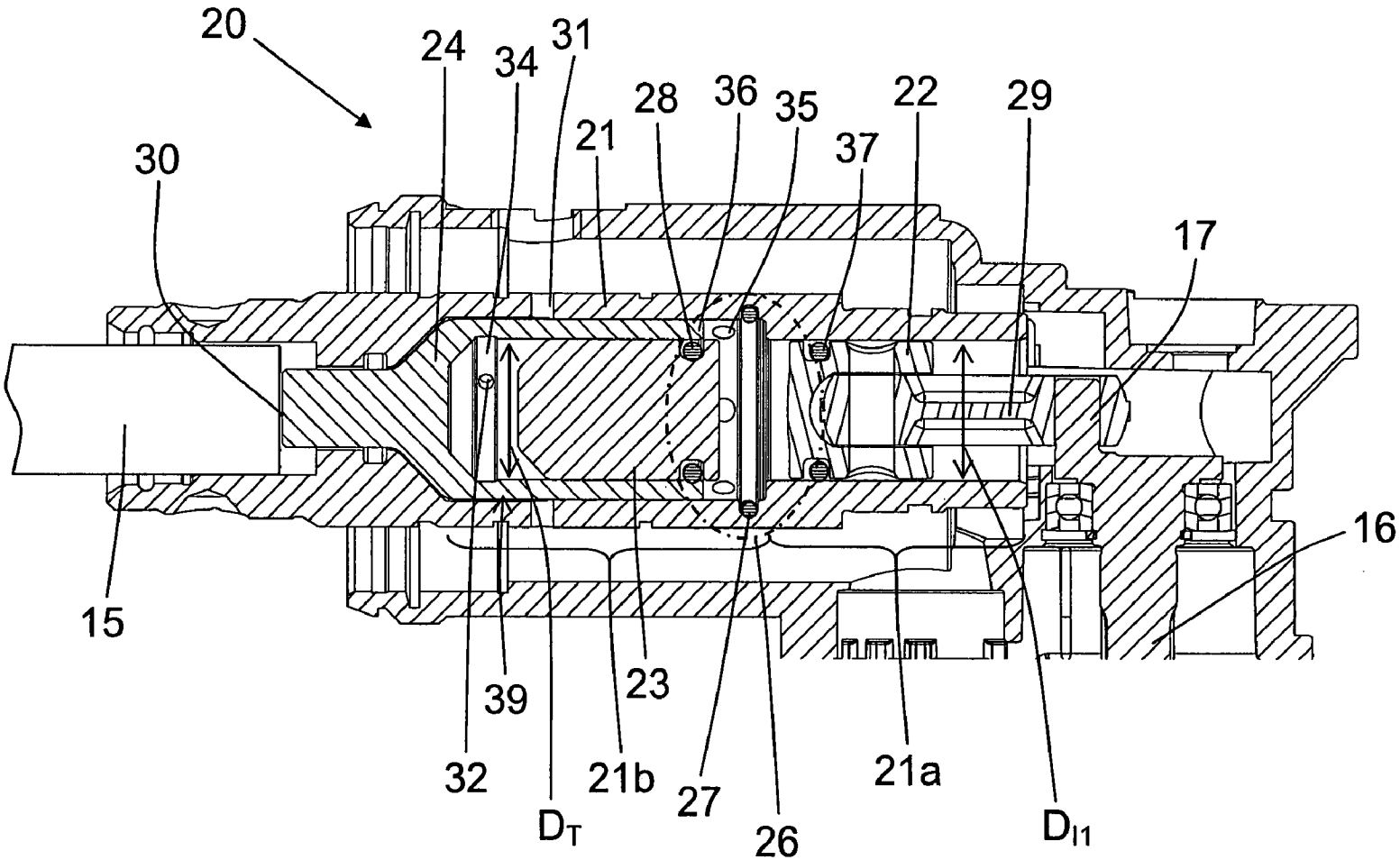
FIG. 3 a cross-sectional view of the section of the power tool shown in FIG. 2, in a condition of the power tool when it is not pressed against a workpiece.

FIGS. 2-3 show the percussion mechanism 20 in detail. The percussion mechanism 20 includes a guide tube 21 in which a driving member 22, which is formed as a driving piston, reciprocates. In order to facilitate the assembly of the percussion mechanism, the guide tube 21 can be formed of two or more parts. For producing a reciprocating movement of the driving member 22, a rod 29, which is pivotally supported on the driving member 22, connects the driving member 22 with an eccentric 17 mounted on the output shaft 16 of the drive gear 13. A pot-shaped anvil 24 is axially displaceably supported in the guide tube 21. A percussion piston 23 is displaceable in a pot space 34 of the pot-shaped anvil 24. The percussion piston 23 and the pot space 34 are so dimensioned that the percussion piston 23 can be completely received in the pot space 34, as shown in FIG. 2.

At its end remote from the percussion piston 23, the anvil 24 has an impact end 30 that can transmit impacts or blows to the working tool 15 inserted in the chuck 14.

Between the driving member 22 and the percussion piston 23, there is located an air spring 25 that can be switched on and off. To this end, the anvil 24 forms with its valve section 36 remote from its impact end 30, and a first seal 27, which is located between the guide tube 21 and valve section 36, a valve 26. The valve section 36 of the anvil 24 functions as a closing body of the valve 26. In the guide tube 21, there is further provided aeration openings 35 through which, at the open valve 26, air from the space between the driving member 22 and the percussion piston 23, can escape in the space outside of the guide tube 21 (see FIG. 3). The diameter $D_T$ of the pot space 34 corresponds to the inner diameter $D_{I1}$ of the drive section 21*a* of the guide tube 21 in which the driving piston 22 is located. Thus, during the operation of the percussion mechanism 20, at active or switched-on air spring 25, the percussion piston 23 can be displaced into the drive section 21*a* of the guide tube 21. An anvil section 21*b* of the guide tube 21, remote from the drive section 21*a*, has a greater inner diameter $D_{I2}$ than the drive section 21*a* so that the pot section 39 of the anvil 24 can be received in the guide tube 21, provided the diameter $D_T$ of the pot space 34 is equal to the inner diameter $D_{I1}$ of the section 21*a* of the guide tube 21.

On the percussion piston 23, there is provided at least one circumferential second seal 28 for sealing against the inner surface of the pot section 29 of the anvil 24 or against the inner surface of the drive section 21*a* of the guide tube 21. The driving member 22 also has at least one annular third seal 37 that seals the driving member 22 against the inner surface of the drive section 21*a* of the guide tube 21. For aeration of the space between an end of the percussion piston 23, adjacent to the impact and 30 of the anvil 24, and the anvil 24, two aeration bores 32 are formed in the end region of the pot section 39 adjacent to the impact end 30. The aeration bores 32 communicate with the aeration openings 31 in the guide tube 21.

FIG. 2 shows, as discussed above, the power tool 10, shown in FIG. 1, in its operational condition in which the working tool 15, which is received in the chuck 14, is pressed against a workpiece (not shown). The anvil 24 is located in a position in which it extends farthest into the guide tube 21 in the direction of the driving member 22. In this position of the anvil 24, the valve 26 is closed because the valve section 36 of the anvil 24 sealingly abuts the first seal 27, and the space between the driving member 22 and the percussion piston 23 does not communicate with the aeration openings 35 (see FIG. 3). The air spring 25 is active or is switched on, and the percussion mechanism 20 works normally.

FIG. 3 shows, as it has already mentioned above, the power tool in a condition in which it is not pressed with the working tool 15, which is secured in the chuck 14, against a workpiece. The anvil 24 is in its end position adjacent to the working tool 15. In this position of the anvil 24, the valve 26 is open, as the valve section 36 of the anvil 24 is spaced from the first seal 27. As a result, the space between the driving member 22 and the percussion piston 23 communicates with the aeration openings 35. The air spring 25, which is located between the driving member 22 and the percussion piston 23 is inactive or is switched off. The percussion mechanism 20 produces an empty impact because the percussion piston 23 cannot be displaced and cannot apply an impact to the working tool.

Figure 4:
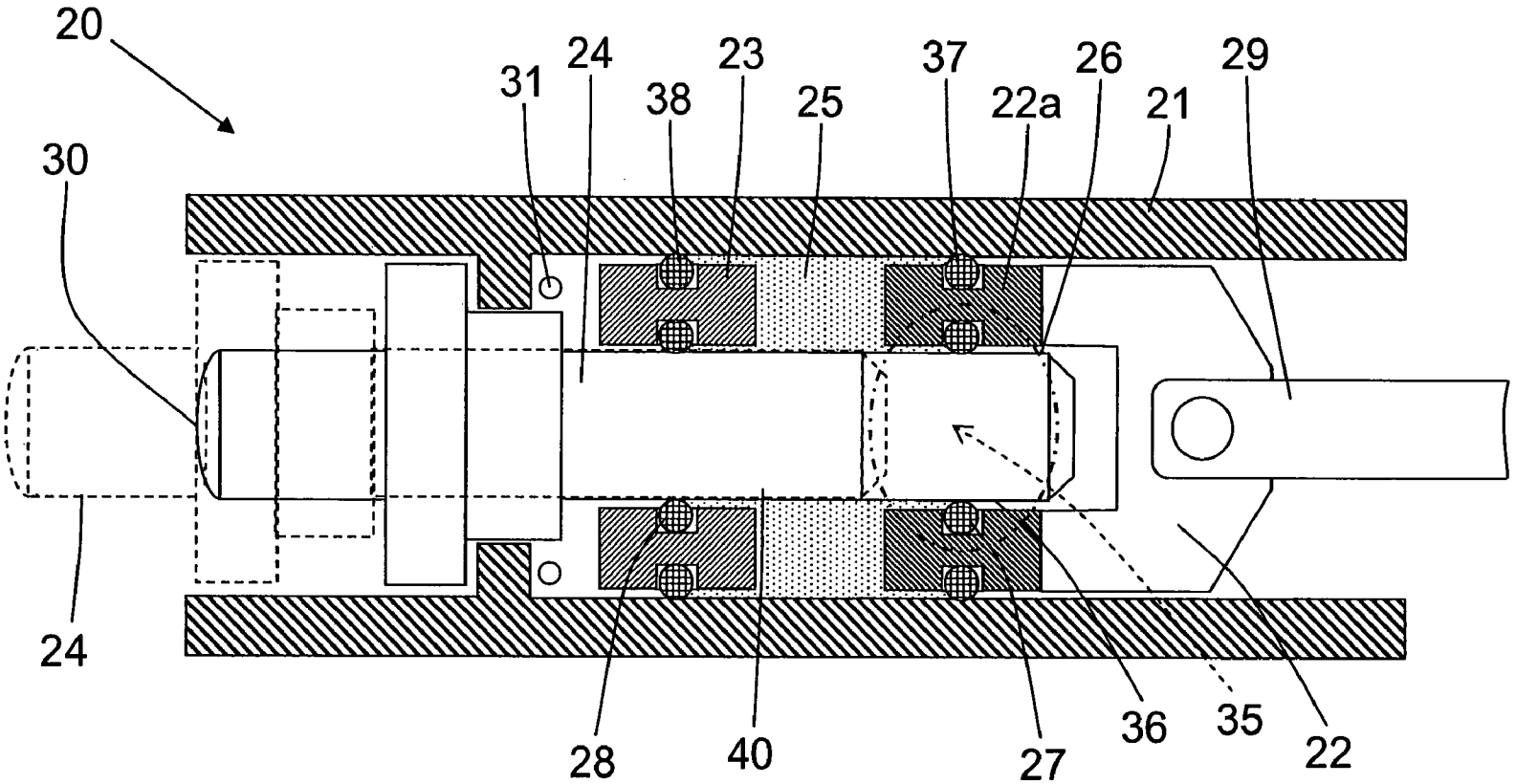
FIG. 4 a cross-sectional view similar to that of FIG. 2 of another embodiment of a hand-held tool according to the present invention.

FIG. 4 shows a further embodiment of the inventive percussion mechanism 20 of the hand-held power tool 10 shown in FIG. 1. As in the embodiment of the percussion mechanism 20 shown in FIGS. 2-3, the percussion mechanism 20 includes a guide tube 21 in which a driving member 22, which is formed as a driving piston, reciprocates. For producing a reciprocating movement of the driving member 22, a rod 29, which is pivotally supported on the driving member 22, connects the driving member 22 with an eccentric 17 mounted on the output shaft 16 of the drive gear 13. An anvil 24 is axially displaceably supported in the guide tube 21. The anvil 24 has an elongate bar-shaped extension 40 that has, at its end region adjacent to the driving member 22, a valve section 36 of the valve 26 and which forms a closing body of the valve 26. The percussion piston 23 is formed as an annular member and is axially displaceably supported on the extension 40, engaging the cylindrical surface of the extension 40 with an annular seal 38 located in an annular groove formed in the inner surface of the percussion piston 23. On the outer circumference of the percussion piston 23, there is arranged a further circumferential seal 38 that seals the percussion piston 23 against the inner wall of the guide tube 21. The driving member 22 has an annular section 22*a* likewise with inner and outer circumferential seals 27 and 37. Further, the inwardly located seals 27 and 28 of the driving member 22 an the percussion piston 23 would be referred to, respectively, as first and second seal, and the outwardly located seals 37, 38 of the driving member 22 and the percussion piston 23, respectively, will be referred to as third and fourth seals. The annular opening of the driving member 22 functions as an aeration opening 35 and cooperates with the valve section 36 of the anvil 24. The valve section 36 of the anvil 24 forms, together with the first seal 27, the valve 26.

FIG. 4 shows the anvil 24 in a first position (continuous lines) in which it is displaced in the guide tube 21 farthest in the direction of the driving member 22 because the power tool 10 (FIG. 1) is pressed with the working tool 15 against a workpiece (not shown). In this position of the anvil 24, the valve 26 is closed as the valve section 36 tightly abuts the first seal 27 provided in the aeration opening 35 in the driving member 22, closing the aeration opening 35. The air spring 25, which is located between the percussion piston 23 and the driving member 22, is active or switched on, and the percussion mechanism 20 functions normally.

In FIG. 4, the anvil 24 is also shown (with dash lines) in its end position, adjacent to the chuck, in which the hand-held power tool 10 is not pressed against a workpiece. In this position of the anvil 24, the valve 26 is open as the valve section 36 of the anvil 24 is spaced from the first seal 27, and the aeration opening 35 in the driving member 22 is open, so that the space between the driving member 22 and the percussion mechanism 23 communicates with the opening 35. The air spring 25 between the driving member 22 and the percussion member 23 in inactive or is switched off. The percussion mechanism 20 produces an empty impact because the percussion piston 23 cannot be displaced and cannot impact the working tool which is received in the chuck.

For the description of elements with reference numerals not mentioned in the description of FIG. 4, reference should be made to the description of FIGS. 1-3.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A pneumatic percussion mechanism for a hand-held power tool, comprising a guide tube (21); an anvil (24); a percussion piston (23) for applying impacts to the anvil (24); a driving member (22) reciprocating in the guide tube (21) for driving the percussion piston; and an air spring (25) for transmitting a driving torque from the driving member (22) to the percussion piston (23) and directly switchable on and off by the anvil (24); and wherein the anvil (24) forms a closing body of a valve (26) for controlling switching of the air spring (25) on and off.

2. A pneumatic percussion mechanism according to claim 1, wherein the anvil (24) is formed as a pot-shaped member having a pot section (39) provided with a valve section (36) that forms the closing body.

3. A pneumatic percussion mechanism according to claim 2, wherein the guide tube (21) has a drive section (21*a*) having a first inner diameter ($D_{I1}$) in which the driving member (22) is displaceable, and an anvil section (21*b*) adjoining the drive section (21*a*) in which the pot section (39) of the anvil (24) is received and which has a second inner diameter ($D_{I2}$).

4. A pneumatic percussion mechanism according to claim 3, wherein the first seal (27) is arranged on an inner surface of the anvil section (21*b*) of the guide tube adjacent to a transition area between the anvil section (21*b*) and the drive section (21*a*).

5. A pneumatic percussion mechanism according to claim 2, wherein the pot-section (39) has an interior pot space (34) in which the percussion piston (23) can completely be received.

6. A pneumatic percussion mechanism according to claim 5, wherein the pot space (34) has a diameter ($D_T$) that corresponds to a first inner diameter ($D_{I1}$) of the drive section (21*a*) of the guide tube (21).

7. A pneumatic percussion mechanism according to claim 1, comprising a first seal (27) located between the guide tube (21) and the closing body of the anvil (24) and forming, together with the closing body, the air-spring controlling valve (26).

8. A pneumatic percussion mechanism according to claim 1, wherein the anvil (24) has an axially extending, elongate extension (40) on which the annular percussion piston (23) is axially displaceable and which has, at an end thereof adjacent to the driving member (22), a valve section (36) that forms the closing body that cooperates with an annular portion (22*a*) of the driving member (22) which encloses an aeration opening (35).

9. A pneumatic percussion mechanism according to claim 8, wherein the valve (26) comprises a first seal (27) located between the valve section (26) of the anvil (24) and the annular portion (22*a*) of the driving member (22) and providing for sealing a space between the driving member (22) and percussion piston (23) whereby the air spring is switched on.

10. A pneumatic percussion mechanism according to claim 9, wherein the first seal (27) is provided on the annular portion (22*a*) of the driving member (22) inwardly thereof.

11. A hand-held power tool, comprising a chuck (14) for receiving a working tool (15); a pneumatic percussion mechanism (20) for applying impacts to the working tool (15); and a motor (12) for driving the percussion mechanism, wherein the pneumatic percussion mechanism (20) includes a guide tube (21), an anvil (24) for applying impacts to the working tool (15), a percussion piston (23) for applying impacts to the anvil (24), a driving member (22) reciprocating in the guide tube (21) for driving the percussion piston; and an air spring (25) for transmitting a driving torque from the driving member (22) to the percussion piston (23) and directly switchable on and off by the anvil (24); and wherein the anvil (24) forms a closing body of a valve (26) for controlling switching of the air spring (25) on and off.

* * * * *